US007014434B2

(12) United States Patent
Fujioka et al.

(10) Patent No.: US 7,014,434 B2
(45) Date of Patent: Mar. 21, 2006

(54) SCROLL FLUID MACHINE

(75) Inventors: Tamotsu Fujioka, Yokohama (JP); Ken Yanagisawa, Yokohama (JP)

(73) Assignee: Anest Iwata Corporation, (JP)

( * ) Notice: Subject to any disclaimer, the term of this patent is extended or adjusted under 35 U.S.C. 154(b) by 0 days.

(21) Appl. No.: 10/913,840

(22) Filed: Aug. 6, 2004

(65) Prior Publication Data

US 2006/0029508 A1 Feb. 9, 2006

(51) Int. Cl.
*F04C 18/00* (2006.01)
*F03C 2/00* (2006.01)

(52) U.S. Cl. ..... 418/55.1; 418/15; 418/55.5; 418/57

(58) Field of Classification Search ..... 418/55.1, 418/15, 55.5, 57
See application file for complete search history.

(56) References Cited

U.S. PATENT DOCUMENTS 940,817 A * 11/1909 Clark et al. ..... 418/6
4,141,677 A * 2/1979 Weaver et al. ..... 418/55.2
4,259,043 A * 3/1981 Hidden et al. ..... 418/55.3
4,396,364 A * 8/1983 Tojo et al. ..... 418/55.1
4,645,437 A * 2/1987 Sakashita et al. ..... 418/55.5
6,077,057 A * 6/2000 Hugenroth et al. ..... 418/55.5
6,709,248 B1 3/2004 Fujioka et al.
6,719,545 B1 * 4/2004 Iizuka ..... 418/55.5

FOREIGN PATENT DOCUMENTS

JP 57-076291 5/1982
JP 58160583 A * 9/1983 ..... 418/57
JP 2-60873 12/1990
JP 09310687 A * 12/1997
JP 2003097456 A * 4/2003

* cited by examiner

*Primary Examiner*—Theresa Trieu
(74) *Attorney, Agent, or Firm*—McKee, Voorhees & Sease, P.L.C.

(57) ABSTRACT

A scroll fluid machine comprises fixed and orbiting scrolls. The fixed scroll has a fixed end plate having inner and outer fixed wraps and the orbiting scroll has an orbiting end plate having inner and outer wraps. Between the fixed and orbiting end plates, an annular partition wall is provided. The orbiting scroll is driven by an eccentric portion of a driving shat to form an inner compressing chamber in which the inner fixed wrap is engaged with the inner orbiting inside the annular partition wall and to form an outer compressing chamber in which the outer fixed wrap is engaged with the outer orbiting wrap between the annular partition wall and a housing. The inner compressing chamber communicates with a rear pressure chamber behind the orbiting end plate thereby preventing the orbiting end plate from being deformed or distorted.

3 Claims, 4 Drawing Sheets

P1 : VACUUM
P2 : ATMOSPHERIC PRESSURE
P3 : COMPRESSING $P_1$ : VACUUM $P_2$ : ATMOSPHERIC PRESSURE $P_3$ : COMPRESSING

SCROLL FLUID MACHINE

BACKGROUND OF THE INVENTION

The present invention relates to a scroll fluid machine used both as a compressor and a vacuum pump for a nitrogen generator and a medical oxygen concentrator.

To concentrate a gas such as nitrogen or oxygen contained in air at room temperature, there are a film-separation method, a PSA method using adsorbent and a method of using oxygen adsorbent (CMS). The film-separation method comprises the steps of pressing air by a compressor, transferring it into a hollow film and simultaneously depressurizing the hollow film by a vacuum pump at an outlet of or on the hollow film.

To concentrate oxygen using a nitrogen adsorbent such as zeolite by an adsorbent-applying PSA method, air taken from the atmosphere is pressurized and forwarded into an absorption tower, in which nitrogen that passes in air is adsorbed, and oxygen-rich air is discharged from an outlet of the adsorption tower. When nitrogen is not adsorbed in the adsorption tower, a path between the upstream and the compressor of the adsorption tower is closed to allow the downstream to communicate with a vacuum pump, by which the adsorption tower is depressurized and adsorbed nitrogen is desorbed to return as exhaust gas to air.

To concentrate oxygen using oxygen adsorbent, air taken from atmosphere is pressurized by a compressor and forwarded into an adsorption tower, in which oxygen in air that passes is adsorbed, and air from which oxygen is removed is discharged from an outlet of the adsorption tower and returned as exhaust gas to air.

When oxygen is adsorbed in the adsorption tower, a path between the upstream of the adsorption tower and the compressor is closed to allow the downstream to communicate with a vacuum pump and the adsorption tower is depressurized by the vacuum pump, so that adsorbed oxygen is desorbed to discharge oxygen-rich air.

In both of the methods, the compressor and vacuum pump are necessary.

In the foregoing, a separate compressor and a separate vacuum pump are provided, and a large space is required to dispose them. It is difficult to locate them in a small area and its transportation is inconvenient to involve increase in cost of transportation.

To solve the disadvantages, the inventors invented a scroll fluid machine having both functions of a compressor and a vacuum pump to enable it to use in a small space and to be transported easily, as disclosed in U.S. Pat. No. 6,709,248.

FIGS. 1 and 2 of the appended drawings illustrate a scroll fluid machine that has a fixed scroll 3 having a spiral fixed wrap 2 on a fixed end plate 1, and an orbiting scroll 7 having a spiral orbiting wrap 6 on an orbiting end plate 5 to form a sealed compressing chamber between the fixed wrap 2 and the orbiting wrap 6, the orbiting scroll 7 being eccentrically revolved on a driving shaft 4, the compressing chamber being separated into an outer compressing chamber "A" and an inner compressing chamber "B" by an annular partition wall 8 of the fixed scroll 3 or the orbiting scroll 7, the outer compressing chamber "A" having an outer inlet 9 and an outer outlet 10 for compressing and discharging a gas sucked through the outer inlet 9, the inner compressing chamber "B" having an inner inlet 11 and an inner outlet 12 for discharging a gas sucked through the inner inlet 11.

At the end of the orbiting wrap 6, a known tip seal 6*a* is fitted to be in sliding contact with the fixed end plate 1 suitably.

A bearing plate 13 is provided behind the orbiting scroll 7 to rotate together with the scroll 7 and has a bearing tube 14 at the back of the bearing plate 13. A bearing 15 is fitted in the bearing tube 14 to support an eccentric portion 4*a* of a driving shaft 4 rotatably.

In operation, the outer compressing chamber "A" is operated as a vacuum pump, while the inner compressing chamber "B" is operated as a compressor.

In the scroll fluid machine, during operation, difference occurs in pressure between the outer compressing chamber "A" and the inner compressing chamber "B". Thus, the inner portion of the orbiting end plate 5 is subjected to higher thrust in a direction such that it moves away from the fixed end plate 1, compared with the outer portion.

Hence, the orbiting end plate 5 is partially distorted or deformed, and contact pressure of the tip seal 6*a* to the fixed end plate 1 is partially variable thereby causing a gap between the fixed plate 1 and the tip seal 6*a* of the inner orbiting wrap 6.

With deformation of the orbiting end plate 5, the bearing plate 13 behind the orbiting scroll 7 is deformed or distorted, thereby acting excessive thrust or inclining force to the bearing tube 14 for the bearing 15 that rotatably supports the eccentric portion 4*a* of the driving shaft 4, which results in decrease in durability of the bearing 15 and generating excessive heat.

SUMMARY OF THE INVENTION

In view of the foregoing disadvantages, it is an object of the invention to provide a scroll fluid machine comprising a fixed scroll and an orbiting scroll between which a compressing chamber is formed, to prevent an orbiting end plate of the orbiting scroll from being deformed or distorted during operation.

BRIEF DESCRIPTION OF THE DRAWINGS

The features and advantages of the invention will become more apparent from the following description with respect to an embodiment as shown in appended drawings wherein.

DETAILED DESCRIPTION OF PREFERRED EMBODIMENT

Figure 1:
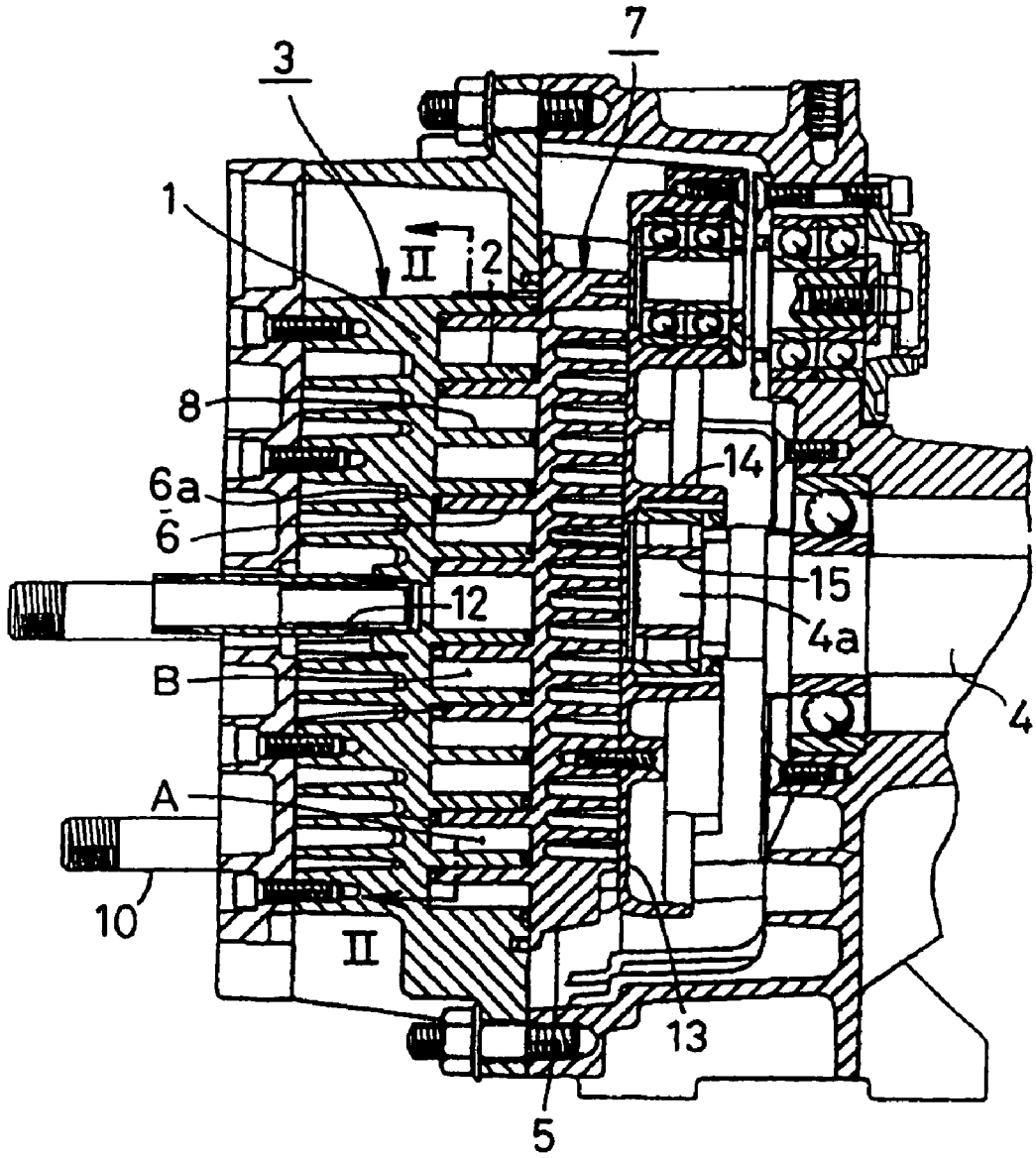
FIG.1 (PRIOR ART)
FIG. 1 is a vertical sectional side view of a conventional scroll fluid machine comprising a compressor and a vacuum pump.
Figure 2:
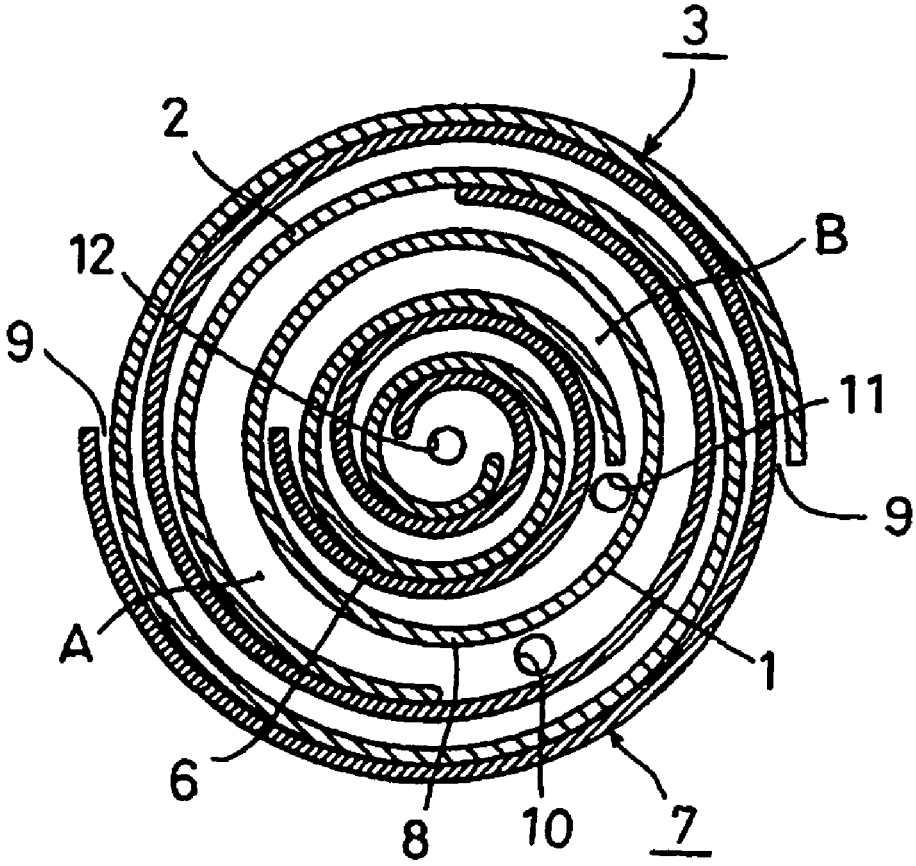
FIG.2 (PRIOR ART)
FIG. 2 is a sectional view taken along the line II—II in FIG. 1.
Figure 3:
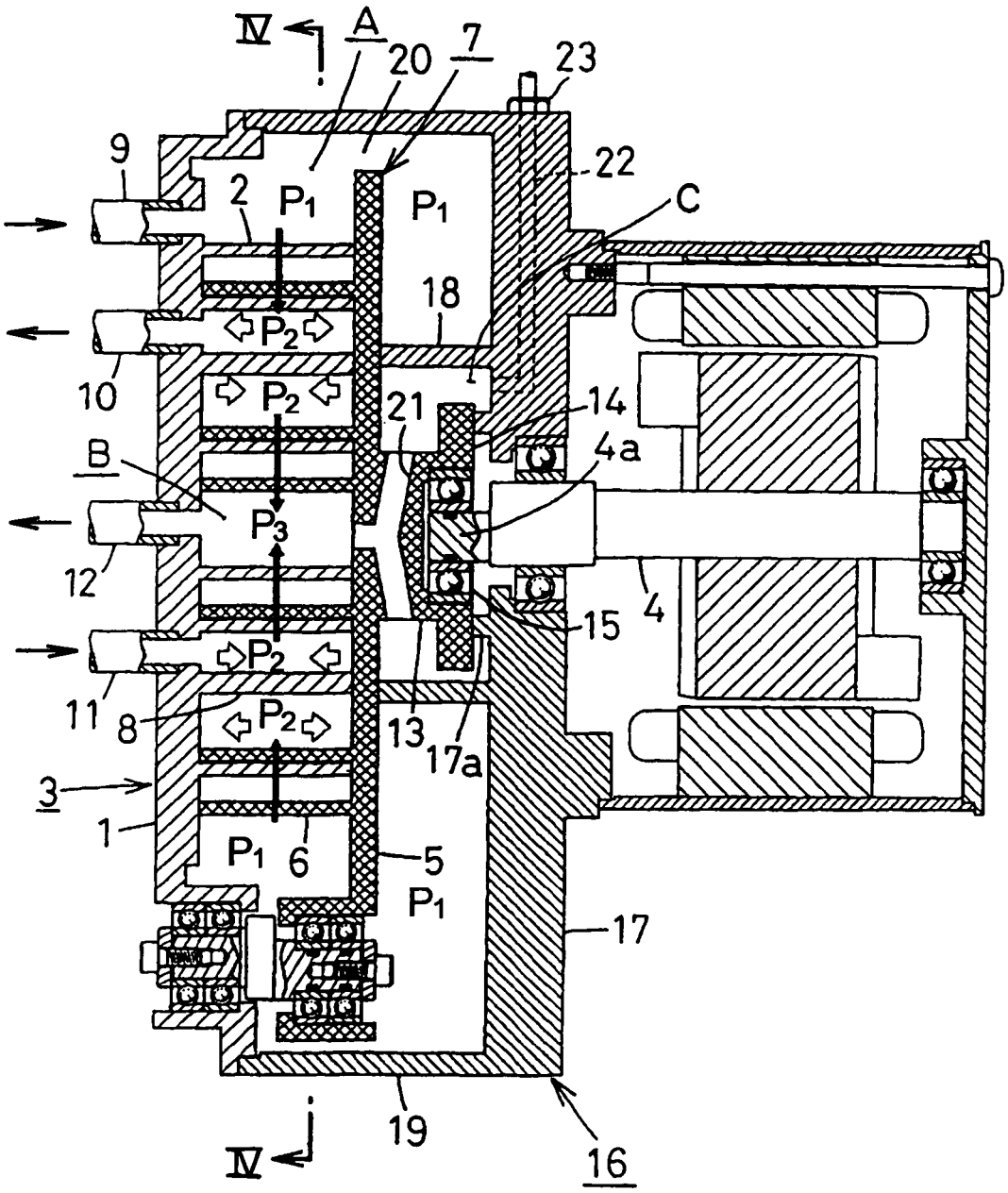
FIG. 3 is a vertical sectional side view of an embodiment of the present invention.
Figure 4:
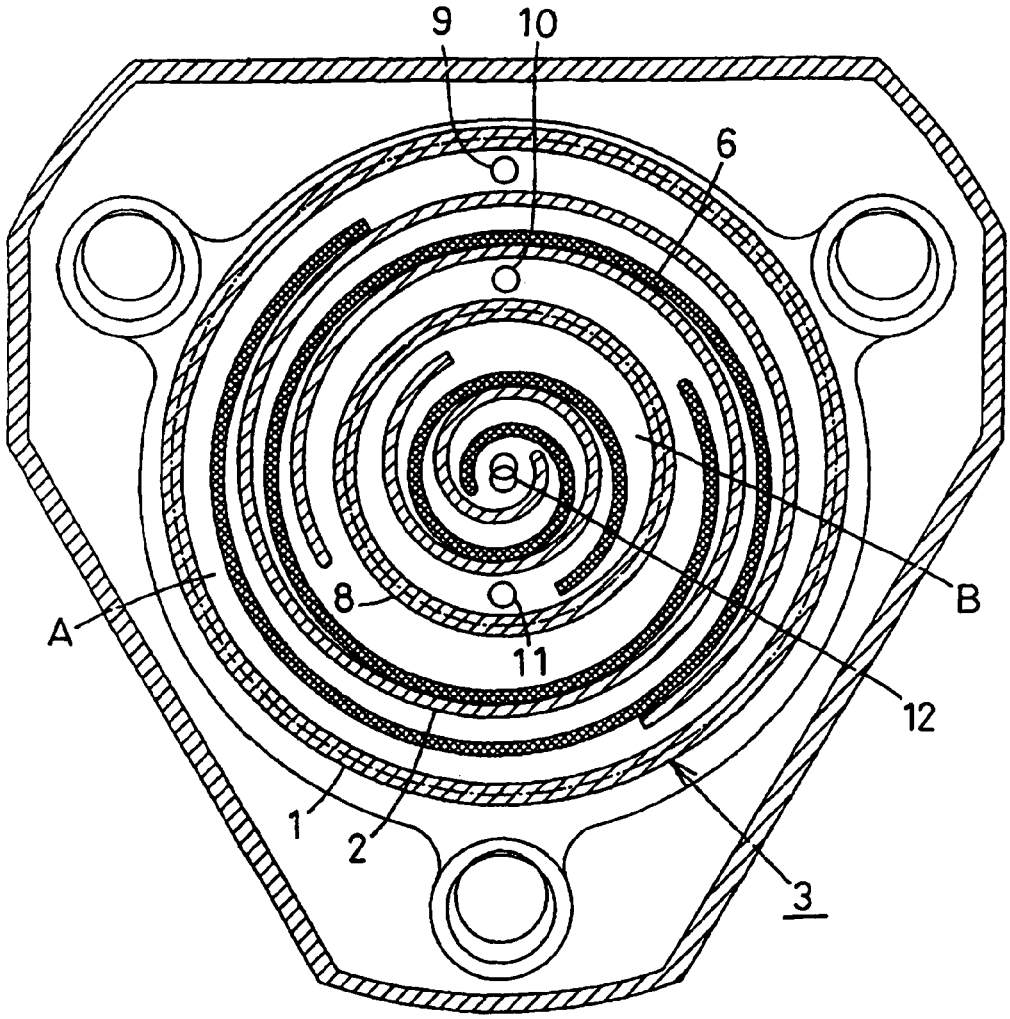
FIG. 4 is a sectional view taken along the line IV—IV in FIG. 3.

FIGS. 3 and 4 are similar to FIGS. 1 and 2, and the same numerals are allotted to the same members. Only differences will be described.

An orbiting scroll 7 is surrounded by a housing 16 which is closed by a fixed scroll 3 at one end The fixed scroll 3 has a fixed wrap 2 with inner and outer portions while the orbiting scroll 7 has an orbiting wrap 6 with inner and outer portions. An annular partition wall 8 is provided on the fixed scroll 3, or on the orbiting scroll 7. On the front surface of a base wall 17 of the housing 16, a bearing plate 13 and a bearing tube 14 are surrounded by a gas-blocking tube 18, the front ends of which are contacted with the rear surface of an orbiting end plate 5 in gas-tight condition.

The rear surface of the bearing tube 14 is in sliding contact with the front end of a support ring 17*a* on the base wall 17 of the housing 16. A suitable tip seal (not shown) may be put on the front ends of the gas-blocking tube 18 and the support ring 17*a*. Thus, behind the middle of the orbiting scroll 7, a rear pressure chamber "C" is formed between the gas-blocking tube 18 and the base wall 17 of the housing 16.

Between a peripheral wall 19 of the housing 16 and the outer circumference of the orbiting end plate 5, a gap 20 is formed. Along the bearing plate 13 behind the orbiting end plate 5, a communicating bore 21 is formed to allow the inner compressing chamber "B" to communicate with the rear pressure chamber "C".

In the embodiment in FIGS. 3 and 4, even if difference is generated in pressure between the outer compressing chamber "A" and the inner compressing chamber "B" in front of the orbiting end plate 5, the pressures leak via the gap 20 and the communicating bore 21 into the rear surface of the orbiting end plate 5 and the rear pressure chamber "C" respectively, thereby making front pressure of the orbiting end plate 5 equal to rear pressure.

That is to say, the outer compressing chamber "A" in front of the orbiting end plate 5 communicates with a space surrounded by the peripheral wall 19 of the housing 16, the base wall 17 and the gas-blocking tube 18 behind the orbiting end plate 5, while the inner compressing chamber "B" in front of the orbiting end plate 5 communicates with the rear pressure chamber "C" surrounded by the orbiting end plate 5, the gas-blocking tube 18 and the base wall 17 of the housing 16 behind the orbiting end plate 5.

Therefore, if pressure in the inner compressing chamber "B" in front of the orbiting end plate 5 becomes significantly high, it acts to the rear surface of the orbiting end plate 5 as well thereby preventing the orbiting end plate 5 from being deformed or distorted axially.

As shown by a dotted line in FIG. 3, a discharge bore 22 and a regulating valve 23 are formed in the housing 16. The rear pressured chamber "C" communicates with the outside via the discharge bore 22. When pressure in the gas-blocking tube 18 is leaked by opening the regulating valve 23, thrust to the bearing 15 and other parts for supporting the orbiting scroll 7 can be regulated.

A discharge tube with a regulating valve may be formed in a space over the outer circumference of the gas-blocking tube 18.

The foregoing merely relates to an embodiment of the invention. Various modifications and changes may be made by a person skilled in the art without departing from the scope of claims wherein:

What is claimed is:

1. A scroll fluid machine comprising— a driving shaft having an eccentric portion;

a fixed scroll comprising a fixed end plate having inner and outer fixed wraps;

an orbiting scroll comprising an orbiting end plate having inner and outer orbiting wraps and driven by the eccentric potion of the driving shaft via a bearing;

a housing comprising a base wall through which the driving shaft passes and peripheral walls, and being closed by the fixed end plate to surround the orbiting scroll; and an annular partition wall between the fixed and orbiting end plates, the orbiting scroll being revolved by the driving shaft with respect to the fixed scroll to form an inner chamber in which the inner fixed wrap is engaged with the inner orbiting wrap inside the annular partition wall and to form an outer chamber in which the outer fixed wrap is engaged with the outer orbiting wrap between the annular partition wall and the housing, the inner and outer chambers being used as a compressor and a vacuum pump respectively, a rear pressure chamber being formed behind the orbiting end plate at a position corresponding to the inner chamber and having high pressure, the inner chamber communicating with the rear pressure chamber via an axially communicating bore of the orbiting end plate to prevent the orbiting end plate from being deformed or distorted axially; and the outer chamber communicating with a space behind the orbiting end plate opposite the outer chamber via a gap between an outer circumference of the orbiting end plate and the peripheral wall of the housing.

2. A scroll fluid machine as claimed in claim 1 wherein the rear pressure chamber is defined by a gas-blocking tube that surrounds the eccentric portion of the driving shaft.

3. A scroll fluid machine as claimed in claim 1 wherein the rear pressure chamber communicates with an outside via a discharge bore in the base wall of the housing, a regulating valve being provided in the discharge bore to regulate pressure in the rear pressure chamber.

* * * * *